US005213473A

United States Patent [19]

Fiala

[11] Patent Number: 5,213,473

[45] Date of Patent: May 25, 1993

[54] RADIAL-FLOW WHEEL FOR A TURBO-ENGINE

[75] Inventor: Andreas Fiala, München, Fed. Rep. of Germany

[73] Assignee: MTU Motoren-und Turbinen-Union Munchen GmbH, Fed. Rep. of Germany

[21] Appl. No.: 758,113

[22] Filed: Sep. 12, 1991

[30] Foreign Application Priority Data

Sep. 15, 1990 [DE] Fed. Rep. of Germany ..... 4029331

[51] Int. Cl.[5] ..... F04D 29/28

[52] U.S. Cl. ..... 416/183; 416/185; 416/188; 416/223 B; 416/DIG. 2

[58] Field of Search ..... 416/179, 182, 183, 185, 416/186, 188, 223 A, 223 B, DIG. 2

[56] References Cited

U.S. PATENT DOCUMENTS

| | | | |
|---|---|---|---|
| 2,469,125 | 5/1949 | Meisser | 416/183 |
| 2,484,554 | 10/1949 | Concordia et al. | 416/183 |
| 3,069,072 | 12/1962 | Birmann | 416/183 |
| 3,904,308 | 9/1975 | Ribaud | 416/185 |
| 4,093,401 | 6/1978 | Gravelle | 416/185 |
| 4,502,837 | 3/1985 | Blair et al. | 416/183 |
| 4,615,659 | 10/1986 | Sidransky | 416/183 |
| 4,904,158 | 2/1990 | Kun | 416/183 |

FOREIGN PATENT DOCUMENTS

| | | | |
|---|---|---|---|
| 2393176 | 2/1979 | France | 416/183 |
| 58041 | 8/1946 | Netherlands | 416/188 |
| 673749 | 7/1979 | U.S.S.R. | 416/185 |

*Primary Examiner*—Edward K. Look
*Assistant Examiner*—James A. Larson
*Attorney, Agent, or Firm*—Evenson, McKeown, Edwards & Lenahan

[57] ABSTRACT

The invention relates to a radial-flow wheel for a turbo-engine comprising a hub and blades distributed on the hub-side outer circumference, the meridian section contour of the outer surface of the hub being a catenarian curve. This radial-flow wheel has the advantage of low frictional losses.

12 Claims, 4 Drawing Sheets

| | | |
|---|---|---|
| — — — | 1a | 22 |
| — - — | 1b | 11,22,44 |
| —·—·— | 1c | 9,13,23,56 |

RADIAL-FLOW WHEEL FOR A TURBO-ENGINE

BACKGROUND AND SUMMARY OF THE INVENTION

The present invention relates to a radial-flow wheel for a turbo-engine having a hub and blades distributed on the hub-side outer circumference.

The significant disadvantage of a radial-flow compressor is the fact that it achieves only an isentropic stage working efficiency of approximately 80 to 84%. In addition to the increasing and detaching of the boundary layer in the housing area this is the result of the fact that the frictional losses between the fluid and the radial-flow wheel and the following diffuser are significantly higher than in the case of an axial-flow compressor.

In this context, the term radial-flow wheel includes an impeller in the case of which the flow direction at the outlet is not strictly radial but also has an axial component.

A disadvantage of conventional radial-flow wheels is the fact that the surfaces of the wheel against which the fluid flows are relatively large, whereby the friction-caused flow losses are increased.

In addition, it is known in the case of radial-flow wheels, to displace the leading edge of some of the blades a certain distance toward the rear in order to reduce the partial blocking of the flow duct caused by the blades and thus ensure the required mass flow. A reduction of the friction-caused flow losses cannot be achieved in this manner.

Based on the above, it is an object of the present invention to develop a radial-flow wheel in such a manner that the frictionally caused flow losses are reduced in comparison to conventional radial-flow wheels.

For a radial-flow wheel of the above-mentioned type, this object is achieved according to a first embodiment of the invention by the fact that th meridian section contour of the outer surface of the hub is a catenarian curve.

In especially preferred embodiments, the catenarian curve can be represented in the form of an axial course (z) as a function of the radius (r) by $z=f(r)$, in which case the contour is by approximation determined by the following solution of the differential equation for minimal surfaces, $$z=d+c \operatorname{arch}(r/c)$$

wherein c and d are constants which result from the edge conditions at the inlet and outlet of the radial-flow wheel, and wherein arch (r/c) is the arcus cosinus hyperbolicus of r/c. The differential equation for minimal surfaces is known from Dr. Bernhard Baule's, "Die Mathematik des Naturforschers und Ingenieurs", Part 2, Publishers Harri Deutsch, Frankfurt/Main, Par. 11, Page 46, 1979. The constants c and d are determined by means of two parameters respectively out of four possible parameter which are the angle of flow, the angle of slope, the axial distance or the radius for the edge conditions at the inlet and outlet of the radial-flow wheel.

The principal advantages of this development of the invention are that a radial-flow wheel having such contours of the outer surface of the hub, in comparison to conventional radial-flow wheels, has a reduced surface in this partial area of the flow duct, and thus the frictional losses on the outer surface of the hub are minimized. The surprisingly resulting course of a catenarian curve according to the invention corresponds to the curve which a chain takes up which is hung between two points of different heights.

Preferably, both surfaces, thus the outer surface of the hub and the enveloping surface of the housing-side outer contour of the blades are provided with a catenarian curve as a meridian section contour in order to obtain the smallest possible surface (minimal surface) in the direction of the housing as well as in the direction of the hub. However embodiments are also contemplated wherein only one of the two surfaces—the outer surface of the hub or the enveloping surface—is shaped according to the invention while the other surface has a conventional design.

It is up to the person skilled in the art to provide, within the scope of the invention, a slight deviation from the ideal catenarian curve if, as a result, other fluidic characteristics can be improved and the resulting surface enlargement remains slight.

Naturally, the inlet or outlet area of the outer surface of the hub or of the enveloping surface of the outer contour of the blades of a radial-flow wheel in its contour may also deviate from the ideal catenarian curve in order to meet specific inlet or outlet requirements.

In addition, the developments described above as well as below apply to radial-flow wheels without any shroud as well as to those with a shroud, which means that in the latter case the enveloping surface of the outer contour of the blades is to be replaced by the inner surface of the shroud.

According to a second embodiment of the invention, the object on which the invention is based is achieved in that the blade surfaces or sections of them are constructed as screw surfaces (minimal surfaces) which are a function of the angle at circumference ($\psi$) by $z=f(\psi)$ and of the radius (r), the blade surfaces by approximation being determined by the vector function $\vec{r}$, with the angle at circumference ($\psi$) and the radius (r) as scalar variables and with $$\vec{r} = \begin{cases} x(r,\psi) = r\cos\psi \\ y(r,\psi) = r\sin\psi \\ z(\psi) = 1 + k\,\psi \end{cases}$$

as well as with x, y, z as the space coordinates and with 1 and k as the constants which are determined by the edge conditions for, for example, the axial distance z and the angle at circumference $\psi$ at the inlet and outlet of the radial-flow wheel. Such screw surfaces are solutions of the differential equation for minimal surfaces wherein the equation shows that any radial of the blade surface passes through the centerline of the hub.

The vector function $\vec{r}$ according to the invention in a cartesian coordinate system describes the surfaces formed by the blades in order to achieve a minimizing of the surfaces against which the flow medium flows while maintaining given known contours for the hub-side outer surface or the enveloping surface of the housing-side outer contour of the blades and blade numbers. This development of the blade surfaces as screw surfaces permits a reduction of the flow losses and thus an increase of the efficiency for a radial-flow wheel according to the invention.

In a further development of this solution of the object according to the invention, the blade surfaces may again in partial areas, particularly in the blade inlet or outlet area, deviate from this contour with a minimal surface without leaving the scope of the invention.

Preferably, the blades have an approximate screw surface as their surface from the inlet to at least half the length of the filament of flow, i.e. the flow path, of the radial-flow wheel. Such a construction of the blade surfaces of the radial-flow wheel advantageously utilizes the idea of the invention for improving the efficiency.

Another preferred embodiment of the invention provides that the surfaces of the blades, on the outlet side, have approximate screw surfaces which extend along at least half the length of the filament of flow of the radial-flow wheel. By means of this development, the efficiency can be advantageously improved in comparison to the conventional blade development of a radial-flow wheel.

Another advantageous development of the invention provides that the spatial curves of the cutting line, i.e. the line of intersection between two surfaces, of the blade surface and the outer surface of the hub and/or the cutting line of the blade surface and the housing-side outer contour of the blades is a chain-screw curve, i.e. the result of a helical curve when viewed in a front view and a catenarian curve when viewed in a meridian section view. The chain-screw curve is a vector function $(\vec{r})$ with the angle at circumference $(\psi)$ as the scalar variable and with $$\vec{(r)} = \begin{cases} x(\psi) = c\,ch\,[(k\cdot\psi + 1 - d)/c]\cos\psi \\ y(\psi) = c\,ch\,[(k\cdot\psi + 1 - d)/c]\sin\psi \\ z(\psi) = 1 + k\cdot\psi \end{cases}$$

wherein c, d, l and k are constants which are determined from the edge conditions at the inlet and outlet of the radial-flow wheel. These constants are the same as described above.

This construction combines the advantages of the two above-described embodiments such that a minimizing of the hub-side and housing-side surfaces can be achieved and that, at the same time, the blade surfaces have minimized surfaces. In the case of this construction, on the whole, a higher reduction of the friction losses can be achieved than in the case of the minimal surface construction of the hub-side outer surface or the enveloping surface of the housing-side outer contours of the blades or the blade surface.

In this context, a chain-screw line is a spatial curve which with the angle as the independent parameter depends only on the angle $(\psi)$ itself. It is the result of a helical curve in the front view and a catenarian curve in the meridian section.

According to another embodiment of the invention, in the case of a radial-flow wheel for a turbo-engine according to the invention, the number of blades is changeable in the axial direction, the blades being arranged behind one another in the flow direction, and in each meridian normal section along the flow duct at an angle of slope $(\epsilon)$ with respect to the radial direction with a hub radius $(R_N)$ and a housing radius $(R_G)$, the number (n) of blades in the flow direction by approximation being determined by the following equation for n:

$$n = \frac{2\pi(R_G + R_N)\cos\epsilon}{2(R_G - R_N)}$$

The construction according to the invention has the advantage that, for a given flow duct cross-section (A) which is bounded by two blades, a hub-side and a housing-side enveloping surface of the blades, a minimal circumference (U) is achieved. By means of a step-by-step increase of the blade number in the flow direction in the case of compressor impellers, or a step-by-step decrease of the blade number in the flow direction in the case of turbine wheels according to the above equation, the surfaces in the flow duct against which the flow occurs are reduced, decreasing the frictionally caused flow losses.

Preferably, the number of blades is doubled step-by-step in specific axial points. In particular, two axial points are provided at which the number of blades doubles in each case. That means that the leading edges of an equal number of shorter blades, which are spaced between the blades starting at the inlet, are disposed at a first axial position. This also occurs at a second axial position s that in the area of the radial-flow wheel outlet of a compressor impeller or of the radial-flow wheel inlet of a turbine wheel, four times the number of blades exist than at the inlet of a compressor impeller or at the outlet of a turbine wheel. When the blade number is doubled at three axial points, the blade number at the outlet is eight times higher than at the inlet.

The determination of those axial points at which the leading edges of the blades displaced toward the rear are located, will be made by the person skilled in the art in coordination with other required flow characteristics. In particular, the axial point may be provided in that position in which the optimal blade number according to the above-mentioned formula has reached twice the value of the blades which were actually present up to that time. However, it is expedient to displace the axial point farther toward the front in order to achieve a loss of efficiency that is as low as possible.

It is advantageous for at least two successive axial sections to be provided with blades which are distributed on the circumference and extend only along the axial length of a section, the trailing edges of the preceding group of blades being followed by the leading edges of the next group of blades in a manner that is staggered in the circumferential direction. The groups of blades may also slightly overlap axially. In particular, three or four successive sections are provided. This construction has the significant advantage that, instead of a doubling of the blade number, arbitrary blade number increases are possible. For example, the blade number in four sections may gradually be increased from 9 to 13 to 23 and finally to 56. In this case, the blades are normally constructed to be only as long as the course of the corresponding axial section; that is, no or only very few blades are provided which extend along the whole radial-flow wheel length. The sections preferably have the same length. However, if necessary, the sections may extend in different manners. This further development of the idea of the invention permits a best possible adaptation of the blade number, which necessarily changes in discrete steps, to the blade number n, which is optimal with respect to the surface minimizing, according to the above-mentioned equation for n.

Preferably, the blades are manufactured in such a manner that they have minimal surfaces; that is, that the blade surfaces, or at least significant parts of the blade surfaces, are constructed as screw surfaces. In addition, it is particularly advantageous for the hub-side outer surface and/or the housing-side rotation surface at the same time to be shaped in such a manner that they have a contour of the type of a catenarian curve in a meridian section. A radial-flow wheel of this type is optimized from the point of view of the frictional resistance; that is, it has the smallest possible surface.

According to an advantageous further development of the invention, the exposed blade edges, along a part of the course or along the whole course, experience a circumferential curvature which is equal to are more pronounced than the meridian curvature. This construction reduces the danger of burblings in the area of the blade tips which also reduce the efficiency.

Preferably, the blades have a backward curvature. A backward curvature means, on the one hand, that the rotating direction of the impeller is opposite to the rotating direction of a particle flowing through the impeller and, on the other hand, that at the impeller outlet, the circumferential component of the mean relative speed vector has the opposite direction of the circumferential speed. The backward curvature has the advantage that, in addition, aerodynamic stress is reduced.

Other objects, advantages and novel features of the present invention will become apparent from the following detailed description of the invention when considered in conjunction with the accompanying drawings.

DETAILED DESCRIPTION OF THE DRAWINGS

Figure 1:
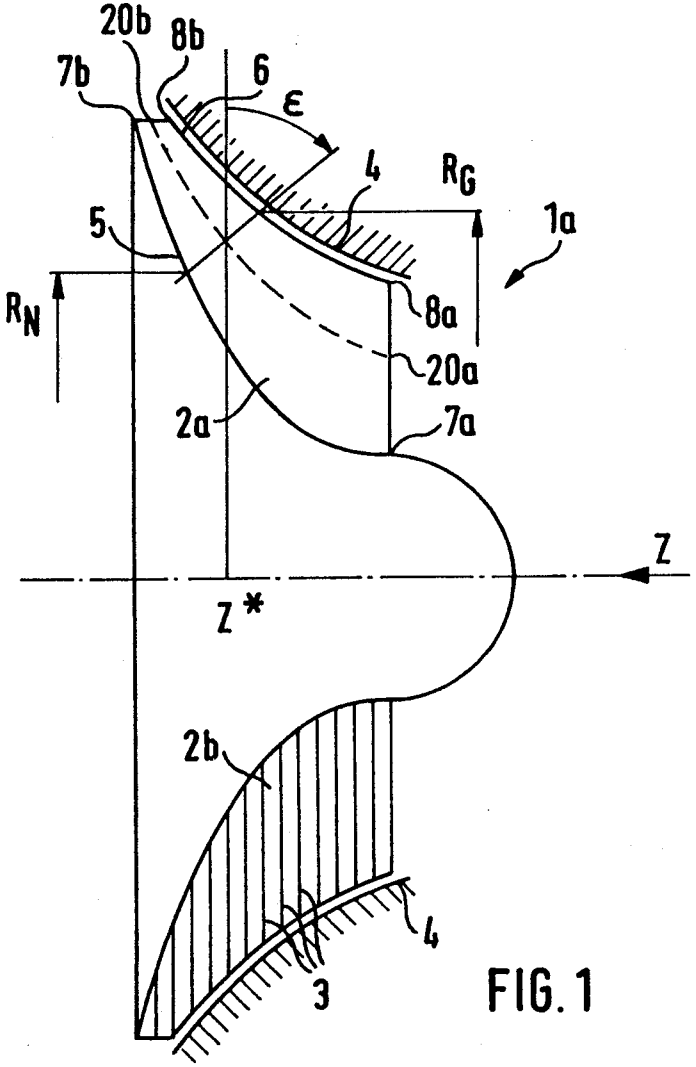
FIG. 1 is a view of a meridian section of a backwardly curved radial-flow wheel constructed according to a preferred embodiment of the invention.

FIG. 1 is a meridian sectional view (circular projection) of a backwardly curved radial-flow wheel 1*a*. In this case, two blades 2*a* and 2*b* are visible which are twisted in the cutting plane, in which case, in the blade 2*b* shown on the bottom in the drawing, uniformly spaced radial generatrices of blade 3 are entered. A flow duct exterior housing 4 is provided radially outside the blades 2*a* and 2*b*, in which case it is also possible to provide a shroud fastened to the free blade edges.

In the shown meridian section, the blade 2*a* has a hub section contour 5 of the hub surface and a housing section contour 6 of the housing surface. These two meridian section contours have a course of a curve which may be called a catenarian curve. This means that the contour corresponds to the curve which a chain would take up that is hung between points 7*a* and 7*b* or 8*a* and 8*b*.

The angle of slope $\epsilon$ can be determined as follows:

A catenarian curve from the central inlet radius (Point 20*a*, surface center) to the central outlet axial distance (Point 20*b*), in Point Z*, has the slope with the angle of slope $\epsilon$, which corresponds to the angle of the meridian normal section with the radial direction.

Figure 2:
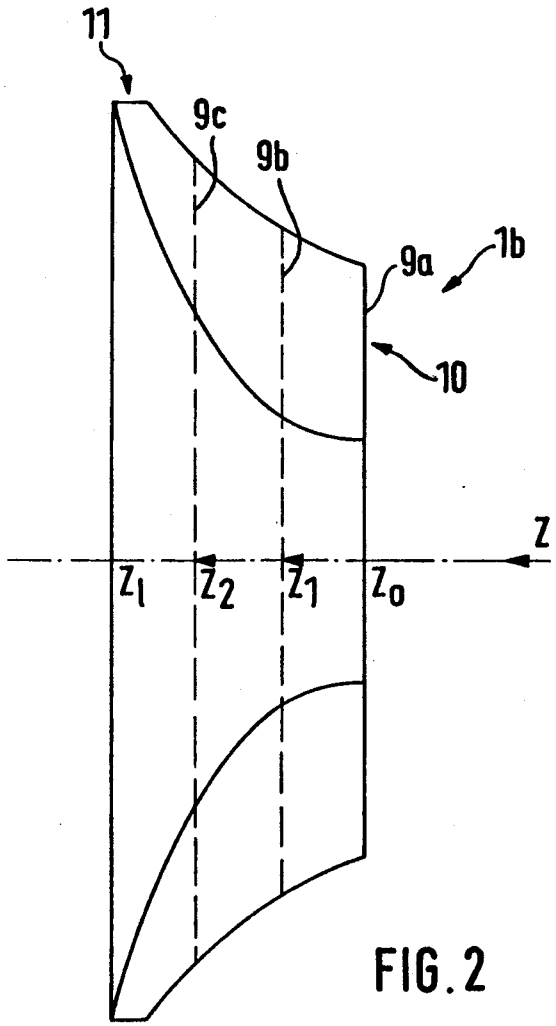
FIG. 2 is a view of a meridian section of another backwardly curved radial-flow wheel constructed according to a preferred embodiment of the invention.

FIG. 2 illustrates a meridian section through another backwardly curved radial-flow wheel 1*b* which, with respect to the meridian section contours, corresponds to the first radial-flow wheel 1*a*. In the case of the radial-flow wheel 1*b*, three blades of different lengths are provided, the leading edges 9*a*, 9*b* and 9*c* of which are visible in the meridian section plane. A first group of blades extends along the whole length of the filament of flow of the radial-flow wheel 1*b*; that is, that the leading edges 9*a* start at the inlet 10 of the radial-flow wheel 1*b*. The blades which start with the leading edge 9*b* are set back by a distance $Z_1$ with respect to the inlet of the radial-flow wheel 1*b*, in which case twice as many blades of this type are provided. This second group of blades ends exactly like the first group of blades at the outlet 11 of the radial-flow wheel 1*b* so that they are all shorter than the blades of the first group.

Finally, leading edges 9*c* of a third group of still shorter blades, which begin at the axial position $Z_z$, are provided, of which there are again twice as many blades as those of the second group and therefore four times as many blades as those of the first group.

Figure 4:
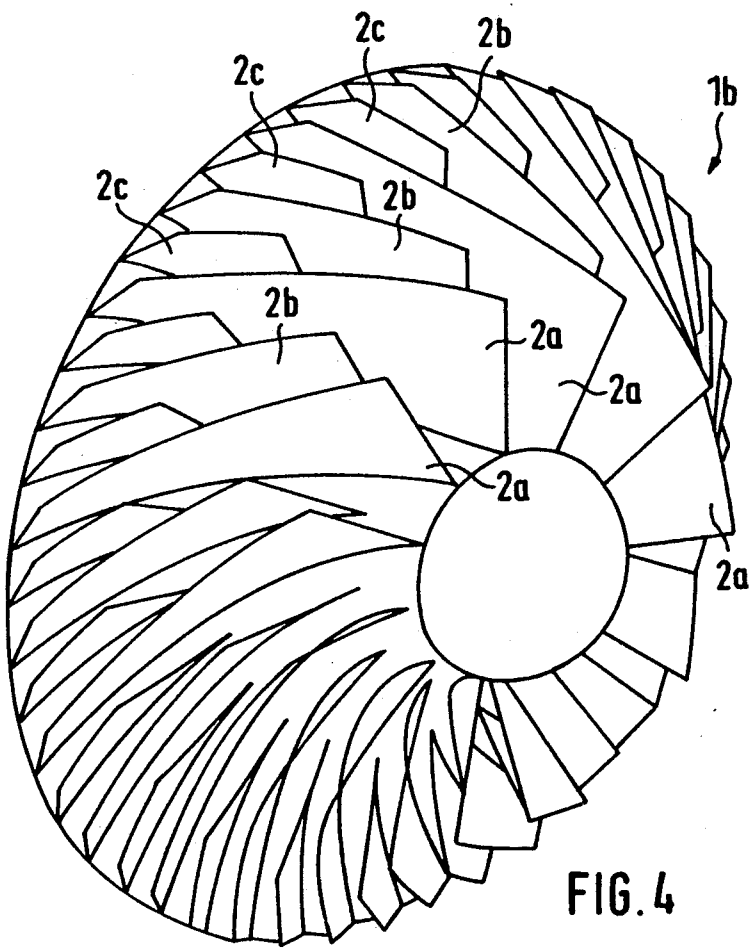
FIG. 4 is a 3-dimensional perspective view of the radial-flow wheel according to FIG. 2 and 3.
Figure 3:
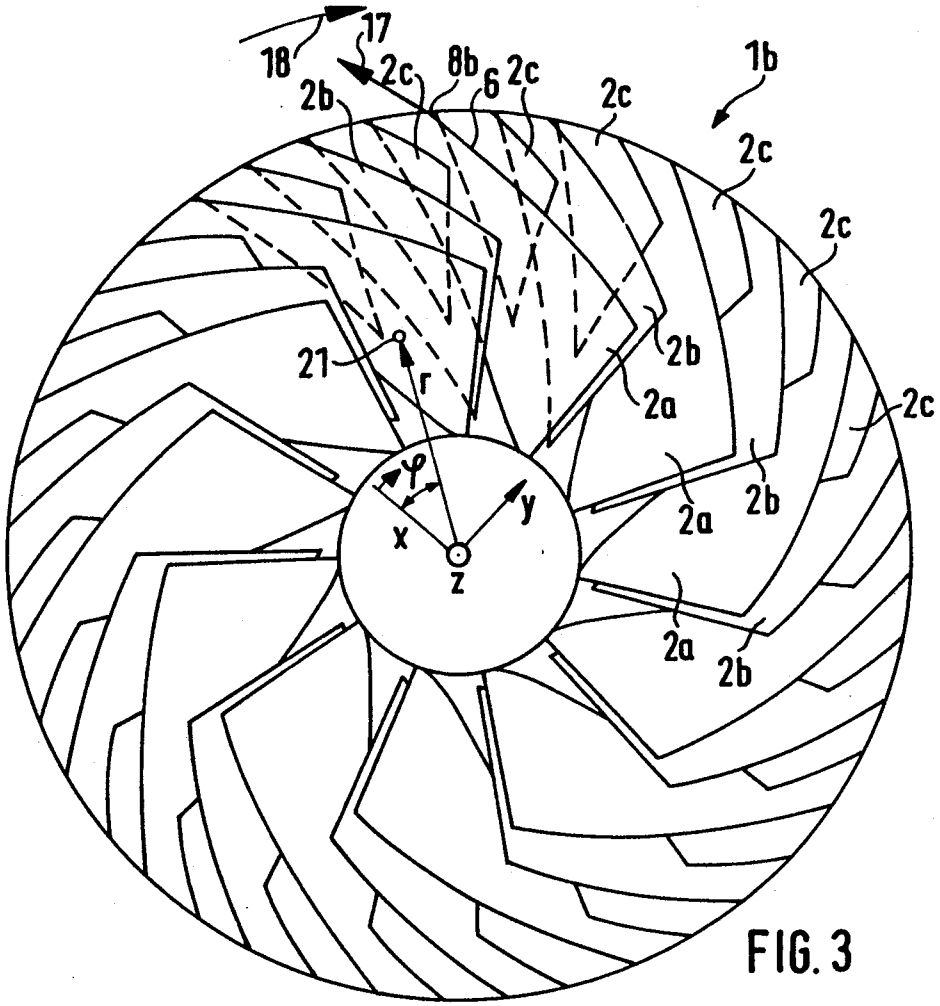
FIG. 3 is an axial view of the radial-flow wheel according to FIG. 2.

In FIGS. 3 and 4, the radial-flow wheel 1*b* according to FIG. 2 is shown as a frontal view and as a 3*d* (perspective) view, in which case the 11 blades 2*a* of the first group—that is, the longest blades 2*a* extending along the whole curve length of the radial-flow wheel 1*b*—are followed by twice as many (thus, 22) blades 2*b* of the second group and by four times as many (thus 44) blades 2*c* of the third group. In the case of this construction, a reduced frictional surface for a given flow cross-section can be achieved. In this case, the blades 2*a*, 2*b* and 2*c* are, in particular, constructed to be curved in the manner of a helical line.

A cartesian coordinate system x-y-z is entered in FIG. 3 with the two independent parameters r and $\psi$, which describe the Point 21 of the blade surface.

The backward curvature of the blades can be recognized by the fact that the positive direction 17 in the Point 8*b* of the housing section contour 6 has an opposite preceding sign to the positive rotating direction 18 of the impeller. In addition, the rotating direction of the impeller is opposite to the rotating direction through which a particle must pass along the housing section contour 6.

A radial-flow wheel 1*b* according to the invention corresponding to FIGS. 2 to 4 has the following values for the constants c, d, k, and 1:

| | |
|---|---|
| On the side of the hub: | c = 40.945 mm |
| | d = 2.789 mm |
| On the side of the housing: | c = 96.372 mm |
| | d = 28.073 mm |

The spatial curve of the blade surface has the following constants:

k=96.990 mm/rad l=0 mm.

The radial-flow wheel 1b also has the following measurements, related to the meridian section points illustrated in FIG. 1:

| | |
|---|---|
| Hub radius in Point 7a: | 41.04 mm |
| Housing radius in Point 8a: | 100.49 mm |
| Hub radius in Point 7b: | 153.90 mm |
| Coordinate system origin: | $Z_o = 0$ mm |

Course in the z-direction between Points 7a and 7b: 84.64 mm;

Course in the z-direction between Points 8a and 8b: 72.59 mm.

Figure 5:
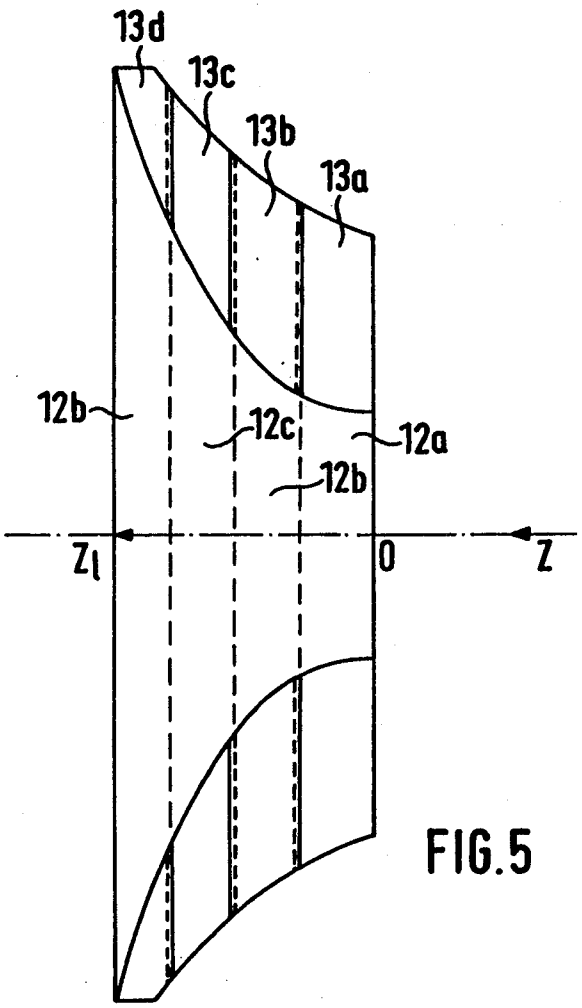
FIG. 5 is a view of a meridian section of another backwardly curved radial-flow wheel constructed according to a preferred embodiment of the invention.

FIG. 5 illustrates a meridian section of another backwardly bent radial-flow wheel 1c which differs from the previous embodiments by the fact that it comprise four sections 12a, 12b, 12c and 12d which are disposed axially behind one another, the blades 13a, 13b, 13c and 13d of the respective sections extending along the respective axial length of the sections 12a–d and are arranged in a slightly axially overlapping manner. The leading and trailing edges of the blades 13a–d extend preferably in a radial manner so that no bending moment caused by centrifugal forces act in the blade base. Exactly as in the blade constructions described farther above, the generatrices of the blades 2a and 2b and 13a–d are radial straight lines, also in order to avoid bending moments. In the shown embodiment, the axial sections 12a–d are equally long, however, if necessary, that is, in adaptation to other required flow conditions, may also be constructed to be of different lengths. The radial-flow wheel 1c according to FIG. 5 is shown in a 3-*d* perspective view in FIG. 6. In the first section 12a, nine blades 13a are provided; in the second section 12b, thirteen blades 13b are provided; in the third section 12c, twenty-three blades 13c are provided; and in the rearmost section 12d, fifty-six blades 13d are provided.

Figure 7:
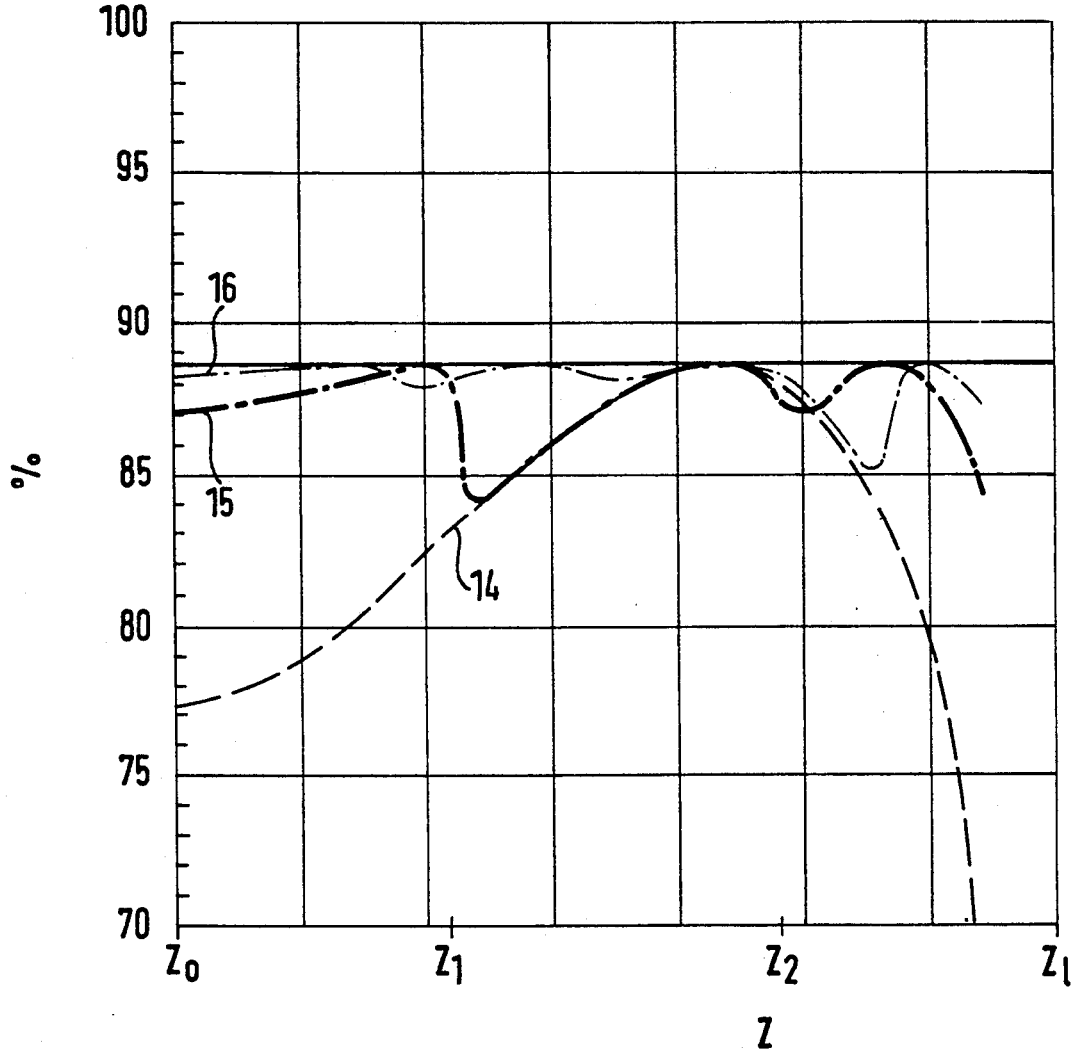
FIG. 7 is a diagram of the surface efficiency above the axial course for radial flow wheels constructed according to preferred embodiments of the invention.

FIG. 7 shows a diagram in which the course of the surface efficiency of different radial-flow wheels is entered above the axial length Z, in which case Zo designates the blade inlet, and $Z_L$ marks the axial end of the blade. The surface efficiency compares the hydraulic diameter $d_{hydr}$ of a flow duct cross-section (A) (meridian normal section) with the circle diameter $d_{theo}$ for the same cross-sectional surface since the circle is the function with the smallest circumference for (U) a given cross-sectional surface. The two diameters may be determined from:

$$d_{hydr} = \frac{4A}{U} = \frac{4\pi(R_G^2 - R_N^2)}{n \cdot \cos\epsilon\left\{\frac{2\pi}{n}(R_G + R_N) + \frac{2}{\cos\epsilon}(R_G - R_N)\right\}}$$

$$d_{theo} = 2\sqrt{\frac{A}{\pi}} = 2\sqrt{\frac{R_G^2 - R_N^2}{n\cos\epsilon}}$$

The theoretically maximally achievable surface efficiency for the rectangular cross-section and the circular-ring section amounts to 86.6% of the circular cross-section and corresponds to the increase in circumference with respect to the ring circumference caused by the square cross-section contour. This value is only theoretically achievable since it would apply to continuously increasing blade numbers, but in reality the blade number can be increased only in discrete steps.

The interrupted line 14 is assigned to a radial-flow wheel 1a (FIG. 1) with twenty-two blades distributed on the circumference. It is shown that the surface efficiency approaches the theoretical value only at one point, specifically where the flow duct bounded by the hub contour and the housing contour and the blades has a square cross-section. The surface efficiency clearly decreases toward the impeller inlet to the left and to the impeller outlet to the right.

Line 15 is assigned to the radial-flow wheel 1b according to the invention corresponding to FIGS. 2 and 3. Two positions are visible which correspond to the axial points $Z_1$ and $Z_2$ according to FIG. 2 at which the blade number is doubles in each case, which results in a change of the contour of the cross-section. In comparison to the radial-flow wheel 1a with only one blade number, the theoretical value of the surface efficiency is reached only three times. On the whole, this radial-flow wheel 1b has a significantly improved surface efficiency in comparison to the radial-flow wheel 1a.

Figure 6:
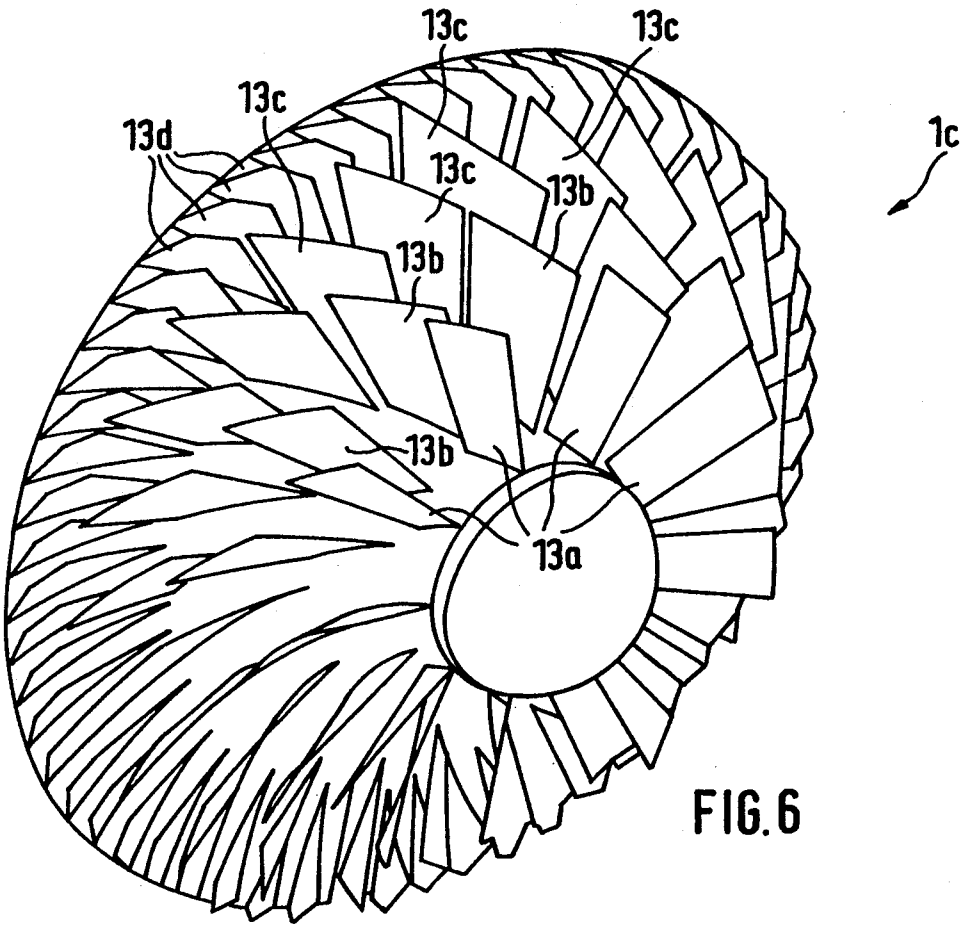
FIG. 6 is a 3-*d* view of the radial-flow wheel according to FIG. 5.

A further improvement can be achieved by means of the radial-flow wheel 1c according to FIGS. 5 and 6 which is entered by means of line 16. In this case, there are three positions at which the blade number is increased, whereby now the theoretical value of the surface efficiency is reached four times.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A radial-flow wheel having a flow channel a flow direction, an inlet and an outlet for a turbo-engine comprising a hub having a hub-side outer contour and blades having a housing-side envelope outer contour and blade surfaces, said blades being distributed on the hub-side outer contour, wherein the blades are arranged behind one another in the flow direction and, in each meridian normal section along the flow direction at an angle of slope ($\epsilon$) with respect to the radial direction with a hub radius ($R_N$) and a housing radius ($R_G$), the number (n) of blades in the flow direction is determined by the following equation which exhibits a square-shaped cross-section of the flow channel:

$$n = \frac{2\pi(R_G + R_N)\cos\epsilon}{2(R_G - R_N)};$$

wherein the meridian section contour of the hub-side outer contour and the housing-side envelope outer contour is a catenarian curve; and wherein at least sections of the blade surfaces are constructed as screw surfaces such that any radial of the blade surfaces must pass through a centerline of the hub.

2. A radial-flow wheel according to claim 1, wherein said radial-flow wheel has an axial coordinate and edge conditions at its inlet and outlet, and wherein the catenarian curve in a direction of the axial coordinate (z), is a function of a radium (r) from said axial coordinate, said catenarian curve being determined by approximation by the following solution of the differential equation for minimal surfaces:

$$z+d+c \text{ arch } (r/c)$$

wherein d and c are constants resulting from the edge conditions and arch r/c is the arcus cosinus hyperbolicus of r/c.

3. A radial-flow wheel according to claim 1, wherein at least two successive axial sections are provided which have blades having trailing and leading edges distributed on the hub side outer contour and extending only along the axial length of a section, the trailing edges of a preceding blade group following the leading edges of a next blade group in a circumferential direction around the hub side outer contour in an offset overlapping manner.

4. A radial-flow wheel according to claim 1, wherein the blades have generatrices which extend radially.

5. A radial-flow wheel according to claim 1, wherein exposed blade edges, along a part of an overall course of said blades, experience a circumferential curvature which is more pronounced than the meridian curvature.

6. A radial-flow wheel according to claim 1, wherein the radial-flow wheel has backwardly curved blades.

7. A radial-flow wheel, which experiences edge conditions at its inlet and outlet for a turbo-engine according to claim 1, wherein the blade surfaces, by approximation, are determined by a vector function $(\vec{r})$, with an angle at circumference $(\psi)$ and a radius (r) as the scalar variables and with $$x(r, \psi) = r \cdot \cos \psi$$
$$\vec{r} = y(r, \psi) = r \cdot \sin \psi$$
$$z(\psi) = 1 + k\,\psi$$

as well as with x,y,z as space coordinates and with l and k as constants which are determined by the edge conditions at the inlet and outlet of the radial-flow wheel.

8. A radial-flow wheel according to claim 7, wherein the blades, from the inlet to at least half the length of a filament of flow of the radial-flow wheel, have an approximate screw surface as their surface.

9. A radial-flow wheel according to claim 7, wherein the surfaces of the blades on the outlet are approximate screw surfaces which extend along at least half of a filament of flow of the radial-flow wheel.

10. A radial-flow wheel for a turbo-engine according to claim 1, wherein a spatial curve of a cutting line of the blade surfaces and at least one of the hub-side outer contour and the cutting line of the blade surfaces and the housing-side outer contour of the blades are catenarian screw curves.

11. A radial-flow wheel which experiences edge conditions at its inlet and outlet according to claim 10 wherein the catenarian screw curves are vector functions $(\vec{r})$ with the angle $(\psi)$ as the scalar variable and with $$x(\psi) = c\,ch\,[k \cdot \psi + 1 - d/c] \cos \psi$$
$$\vec{r} = y(\psi) = c\,ch\,[k \cdot \psi + 1 - d/c] \sin \psi$$
$$z(\psi) = 1 + k\,\psi$$

c, d, l and k being constants which are determined from the edge conditions at the inlet and outlet of the radial-flow wheel.

12. A radial-flow wheel, according to claim 1, wherein the number of blades of the radial-flow wheel at the outlet is one of two times, four times and eight times as high as at the inlet.

* * * * *